US007038403B2

(12) United States Patent
Mastrangeli et al.

(10) Patent No.: US 7,038,403 B2
(45) Date of Patent: May 2, 2006

(54) METHOD AND APPARATUS FOR MAINTAINING ALIGNMENT OF A CYCLOTRON DEE

(75) Inventors: Edward J. Mastrangeli, Brookfield, WI (US); Nevin R. Johns, Severna Park, MD (US); Roger Deane Smith, Waukesha, WI (US); Timothy E. Erickson, Waukesha, WI (US)

(73) Assignee: GE Medical Technology Services, Inc., Pewaukee, WI (US)

( * ) Notice: Subject to any disclaimer, the term of this patent is extended or adjusted under 35 U.S.C. 154(b) by 261 days.

(21) Appl. No.: 10/631,425

(22) Filed: Jul. 31, 2003

(65) Prior Publication Data

US 2005/0023948 A1 Feb. 3, 2005

(51) Int. Cl.
*H05H 13/00* (2006.01)

(52) U.S. Cl. ..... 315/502; 315/111.31; 313/62; 313/359.1; 313/363.1

(58) Field of Classification Search ..... 315/502, 315/111.31; 313/62, 359.1, 363.1
See application file for complete search history.

(56) References Cited

U.S. PATENT DOCUMENTS 3,794,927 A * 2/1974 Fleischer et al. ..... 315/500
4,641,104 A * 2/1987 Blosser et al. ..... 315/502
5,763,986 A * 6/1998 Nakanishi et al. ..... 313/62

* cited by examiner

*Primary Examiner*—Nikita Wells
(74) *Attorney, Agent, or Firm*—Fletcher Yoder

(57) ABSTRACT

A technique is provided for the alignment of an H/D puller for use in a cyclotron. One aspect of the technique comprises magnetically attaching a pair of feeler gages to an alignment tool for use in aligning the H/D puller. The magnetic retention of the feeler gages allows a field engineer to make the desired adjustments to align the H/D puller. Another aspect of the present technique provides for the H/D puller to include a replaceable tip such that the tip may be replaced without removing the H/D puller. Because the H/D puller is not removed and replaced, the alignment of the H/D puller to the ion source is maintained.

21 Claims, 3 Drawing Sheets

METHOD AND APPARATUS FOR MAINTAINING ALIGNMENT OF A CYCLOTRON DEE

BACKGROUND OF THE INVENTION

The present invention relates generally to the field of cyclotron configuration and maintenance. In particular, the present invention relates to the maintenance and alignment of an H- or D-puller for use in a cyclotron.

As medical imaging technology advances, various non-invasive images of a patient's body have become feasible. For example, structural images, such as of the internal arrangement of bones and organs, are typically visible using techniques such as magnetic resonance imaging (MRI), X-ray, and computed tomography (CT). These techniques may also be modified in some instances to produce functional images, i.e., images depicting the metabolic or pharmacokinetic behavior of the patient. However, functional images obtained by nuclear medicine imaging techniques are often superior because of the higher signal to noise ratio that images obtained by other means.

Examples of nuclear medicine imaging techniques include single photon emission computed tomography (SPECT) and positron emission tomography (PET). The nuclear medicine imaging techniques typically measure the decay of a radiopharmaceutical that is preferentially taken up by an organ or system of interest. As the radiopharmaceutical decays, it emits gamma rays of sufficient energy to escape the body which may be detected on a gamma ray detector. The gamma ray detector is typically a component of a SPECT or PET system and produces signals in response to the measured gamma rays that can be used to formulate diagnostically useful functional images. For example, the functional images may describe the uptake and processing of the pharmacologic agent by the organ or system of interest.

The radiopharmaceutical giving rise to these gamma rays is generally a pharmaceutical agent attached to or incorporating a radionuclide. Upon decay of the radionuclide, the gamma rays are emitted and subsequently measured outside the patient's body. The selection of the radionuclide is generally based upon a variety of factors. Among these factors are the chemical properties and the useful lifespan of the radionuclide. Due to the relatively short useful life of the radionuclide, the radionuclide may be prepared at a local or regional facility using a cyclotron to accelerate particles to velocities suitable for inducing the desired nuclear reactions.

The cyclotron itself is a form of particle accelerator which comprises a variety of components that, as one might expect, must be maintained and kept in careful alignment for proper operation. For example, the accurate alignment of the various openings and accelerating apertures through which the particles pass is an important consideration both during the initial installation and during any subsequent maintenance procedures. In particular, it is not only desirable to insure accurate alignment of these components but to allow the alignment and maintenance operations to be performed rapidly to minimize system down time and the time spent by field engineers in and around the cyclotron tank. A technique allowing the rapid and accurate alignment of components of a cyclotron is therefore desirable.

BRIEF DESCRIPTION OF THE INVENTION

The present technique provides a novel method and apparatus for aligning an H/D puller and/or replacing the tip of an H/D puller in a cyclotron. In one aspect of the present technique, an alignment tool is employed to align an H/D puller to the ion source. The alignment tool incorporates magnetic surfaces that are configured to retain a pair of feeler gages in the proper orientation. A field engineer may thereby make alignment adjustments to the H- and/or D-puller while the feeler gages are held by the magnets. In addition, the H/D puller may include a removable tip that may be replaced without removing the H/D puller from the cyclotron assembly. Upon replacement of the tip, it is not necessary to realign the H/D puller.

For example, one aspect of the present technique provides a method for aligning an H/D puller and an ion source. An alignment tool is positioned in a cyclotron such that the alignment tool may be used to align an H/D puller to an ion source. A first feeler gage and a second feeler gage are attached to at least one magnetic surface of the alignment tool such that the first feeler gage and the second feeler gage measure different dimensions. To align the H/D puller to the ion source, a first surface of the H/D puller is contacted to the adjacent first feeler gage and a second surface of the H/D puller is contacted to the adjacent second feeler gage.

In another aspect of the present technique, method for repairing an H/D puller is provided. A first H/D puller tip is removed from an H/D puller body. A second H/D puller tip may then be attached to the H/D puller body. Apparatus and system claims that afford functionality of the type defined by such methods are also provided by the present technique.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Radionuclides may be used in a variety of scientific and technical endeavors. For example, radionuclides may be attached to or incorporated in a biologically active agent to form radiopharmaceuticals for use in nuclear medical imaging or in biological research. Radiopharmaceuticals of this type are often used in positron emission tomography (PET) and single photon emission computer tomography (SPECT) to non-invasively generate functional images of an organ or system of interest in a patient.

Figure 1:
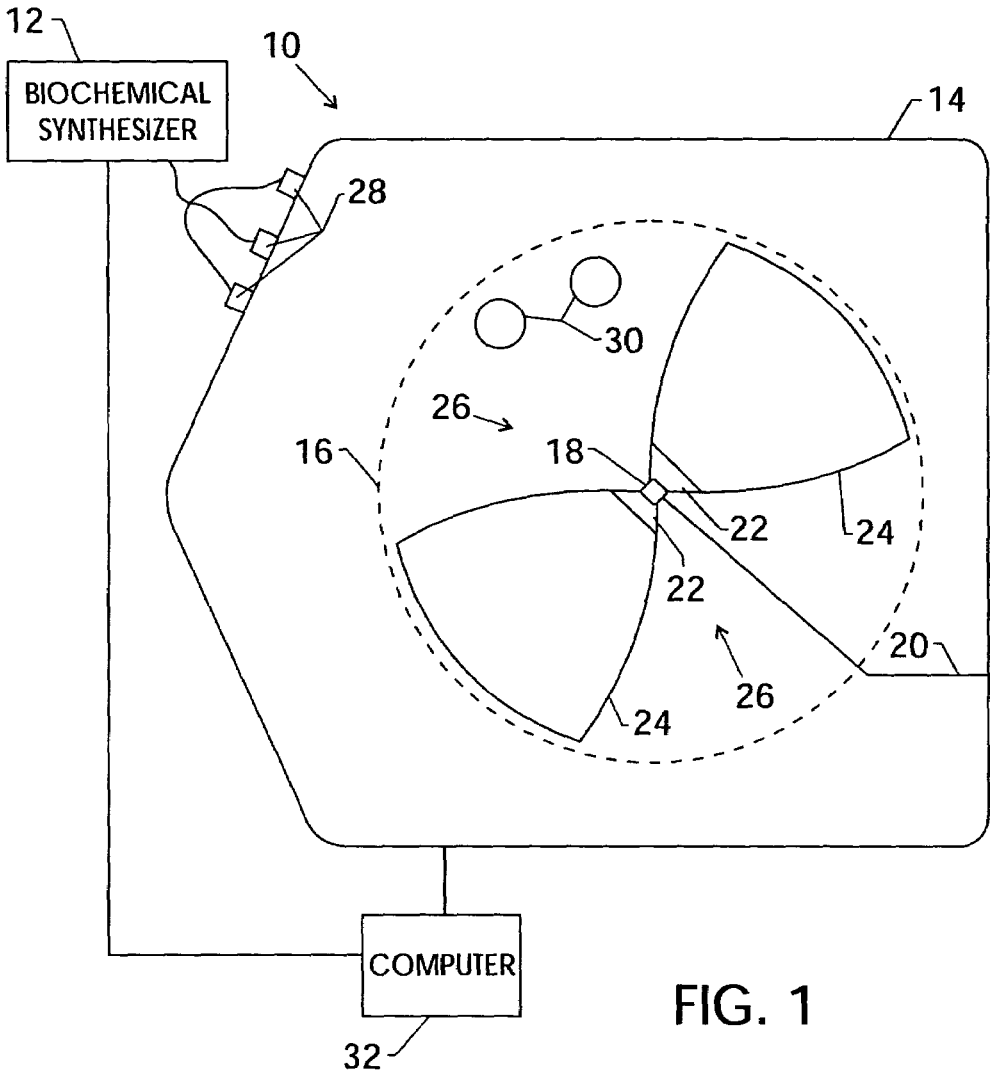
FIG. 1 is a diagrammatic representation of a cyclotron, in accordance with one aspect of the present technique.

Generation of radionuclides for incorporation into the radiopharmaceuticals is typically done using a using a particle accelerator, such as a cyclotron 10, as depicted in FIG. 1. Due to the short half-life of the radionuclide, i.e., the time it takes for half of the sample of radionuclide to decay, the cyclotron 10 may be locally or regionally located relative to the examination site to reduce the transport time of the radiopharmaceutical. Incorporation of the radionuclide into the radiopharmaceutical may occur in a biochemical synthesizer 12 connected to the cyclotron 10 such that the radionuclide is available to the biochemical synthesizer 12 soon after formation.

The cyclotron 10 comprises a vacuum tank 14 within which a near vacuum is maintained when maintenance is not being performed. The poles 16 of a large electromagnet are disposed along the main walls of the tank 14 such that the poles 16 face each other when the tank 14 is sealed. Between the two poles 16, an ion source 18 generates a stream of ions to be accelerated by the cyclotron 10. For example, a plasma may be generated at the ion source, such as by high voltage DC energy delivered by a coaxial line 20. The high voltage may ionize a source material, such as hydrogen or deuterium to generate a plasma in which ions, i.e., charged particles, are formed.

The ions are then pulled from the ion source 18 by one of two pullers, an H-puller through which hydrogen ions are removed and a D-puller through which deuterium ions are removed. For simplicity, a puller will be referred to as an H/D puller 22 herein, unless reference to a particular puller is desired. After removal from the ion source 18 by the H/D puller 22, the ions move through one of two D-shaped hollow, semi-circular metal electrodes, called Dees 24, which are positioned between the poles 16 of the electromagnet and which are separated from one another by a gap 26. Between the magnet poles 16 there is a vertical magnetic field that constrains the direction of motion of the ions. In the gap 26 separating the Dees 24 there is an accelerating electric field generated by an RF potential applied to the Dees 24.

The ions are accelerated when in the gap 26 between the Dees 24 by the electric field generated by the RF power generator. The magnetic field within the Dees 24, however, constrains the ions to a semicircular course within the Dees 24 that returns the ions to the gap 26 for further acceleration. While the ions are in the Dee 24, the electric field within the gap 26 is reversed so that when the ions reemerge they are accelerated to the other Dee 24. The net result is that the ions are repeatedly passed through the gap 26 to be accelerated until the desired velocity (energy) is achieved, tracing a spiral path from the ion source 18 outward to the extraction radius.

Once the ions make the desired number of spiral rotations or attain the desired velocity (energy), they are released from the repeated acceleration and directed to one or more targets 28 containing the material to be irradiated, such as $^{18}O$ or other material or gasses. The ions react with the nucleus of the targeted material, generating radionuclides, such as fluorine 18, that may be incorporated with a biological agent, such as glucose, in the biochemical synthesizer 12 to generate a radiopharmaceutical.

To redirect the ions to the target 28, various types of extractive methods may be employed. For example, for positive ion beams, such as $H^+$ beams, an extraction magnet of opposite polarity to the electromagnet may be employed to bend the beam of particles out of the gap 26. For negative ion beams, such as $H^-$ beams, one or more carousels 30 may be employed. The carousels 30 include a carbon foil that, when struck by the negative ions, strips the electrons from the ion, reversing the charge of the ion to form a positive ion beam. As a result of the charge reversal, the positive ion beam thus created is steered toward the target 28 by the main electromagnet.

A computer 32 may be connected to the cyclotron 10 and/or the biochemical synthesizer unit 12 to monitor and/or control the operation of the devices. The computer may coordinate operation of the ion source, the electromagnet, or other components of the cyclotron 10. The computer 32 may, for example, coordinate the motion of the extraction mechanism within the cyclotron 10 such that the emerging particle beam may be steered between multiple targets 28. In this manner, different or additional targets may be processed as desired.

As one of ordinary skill in the art will appreciate, the alignment of the various components of the cyclotron may be important to the performance and efficiency of the cyclotron 10. However, due to the small apertures and tight tolerances that may exist between some components, satisfactory alignment may be difficult to achieve. For example, the alignment between the H/D puller 22 and the ion source 18 may substantially impact the performance and efficiency of the cyclotron 10 as this alignment controls the amount of ions pulled into the Dees 24. The alignment of the H/D puller 22 is based on measurement in two dimensions, denoted x and y, and has tolerances of approximately +/−0.05 mm.

To align the H/D pullers 22 and the ion source 18, the vacuum tank 14 is opened and the ion source 18 is removed. An alignment tool may then be inserted to overly the region occupied by the ion source 18 during operation. Two separate feeler gages, one for each dimension, may then be held against the alignment tool to provide measurements and spacing in the x and y dimensions. The H/D puller 22 may then be aligned with the feeler gages and the alignment tool while a technician or field engineer adjusts the H/D puller 22, typically via one or more adjustment screws. As one of ordinary skill in the art will appreciate, the alignment process may be difficult to perform due to the difficulty in adjusting the one or more screws while simultaneously holding the feeler gages.

Figure 2:
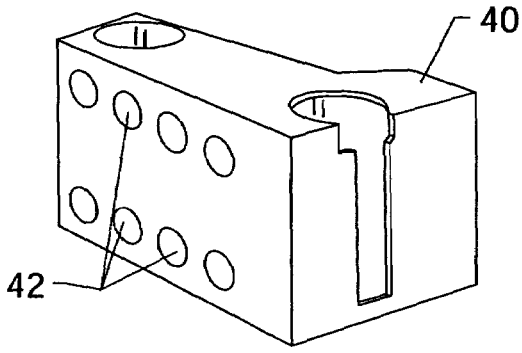
FIG. 2 is a perspective view of an alignment tool, in accordance with one aspect of the present technique.
Figure 3:
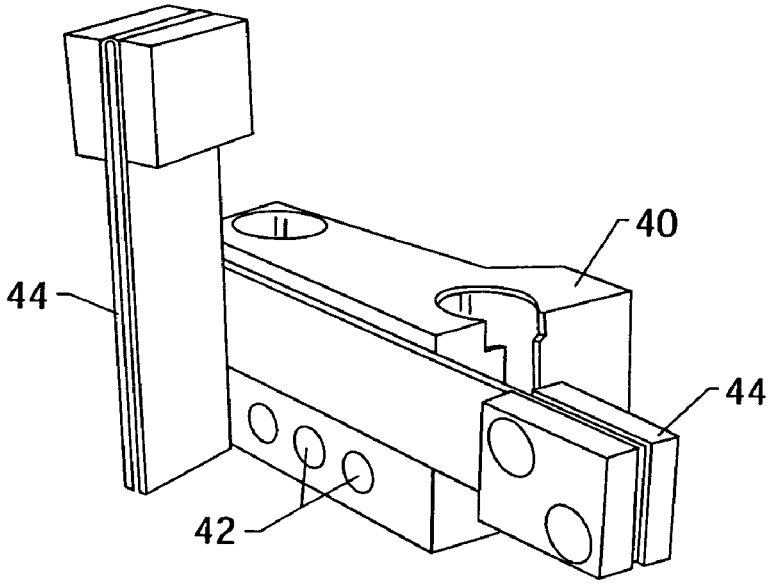
FIG. 3 is a perspective view of the alignment tool of FIG. 2 retaining a pair of feeler gages, in accordance with one aspect of the present technique.
Figure 4:
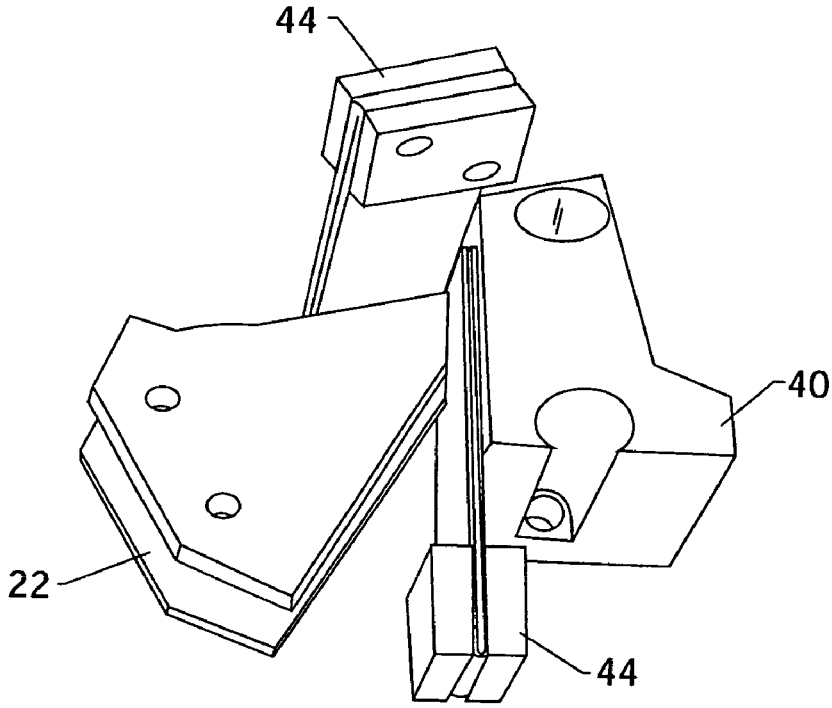
FIG. 4 is a perspective view of an H/D puller aligned with the alignment fixture of FIG. 3, in accordance with one aspect of the present technique.

However, referring to FIG. 2, the alignment tool 40 may be modified to include one or more magnetic surfaces 42. The magnetic surfaces 42 are positioned to hold the pair of feeler gages 44 in the appropriate positions for the alignment of either or both of the H/D pullers 22. For example, referring to FIG. 3, a pair of feeler gages 44 are attached to the alignment tool 40 such that they provide spacing in the respective x and y directions. In particular, a feeler gage 44 may typically be incremented by 0.05 mm in the respective x or y direction. The field engineer or technician may therefore increment each gage 44 in an appropriate amount, as may be determined during production testing or from prior alignment operations. The field engineer may then attach each incremented feeler gage 44 to the alignment tool 44 in the respective dimension. The magnets 42 hold the properly incremented gage 44 in place, allowing the field engineer to adjust the alignment screws of the H/D puller 22 without having to also hold the feeler gages 44. For example, referring to FIG. 4, an alignment tool 40 with magnetic surfaces 42 is depicted holding a pair of feeler gages 44 in their respective positions such that the H/D puller 22 may be aligned against the gages 44 with the proper spacing in the x and y dimensions. After alignment of the first H/D puller 22, the feeler gages 44 may be incremented, based on previous alignment or factory testing, and positioned for alignment of the second H/D puller 22. After alignment of both H/D pullers, the alignment tool 40 and feeler gages 44 may be removed, the ion source 18 replaced, and the vacuum tank 14 resealed and vacated for operation. By using the alignment tool 40 incorporating the magnetic surfaces 42, the alignment of the H/D pullers 22 may be accomplished more rapidly, improving the efficiency of the field engineer, repeatability of the x, y measurements, and the availability of the cyclotron 10 to the operator.

In addition, the H/D puller 22 may be designed to reduce the frequency of alignment operations. In particular, the plasma generated in the ion source 18 may wear and abrade the aperture of the H/D puller 22 over time. As the aperture abrades it may widen, allowing a greater number of ions to pass through to the Dee 24. The wearing of the aperture thereby produces a result similar to a misalignment of the H/D puller 22, i.e., a broadening of the particle beam due to the uptake of too many ions from the ion source 18. Eventually the wear on the aperture of the H/D puller 22 decreases efficiency to the point where it is desirable to remove and replace the H/D puller 22. The replacement H/D puller 22 can then be aligned to the ion source 18, such as by the techniques described herein.

Figure 5:
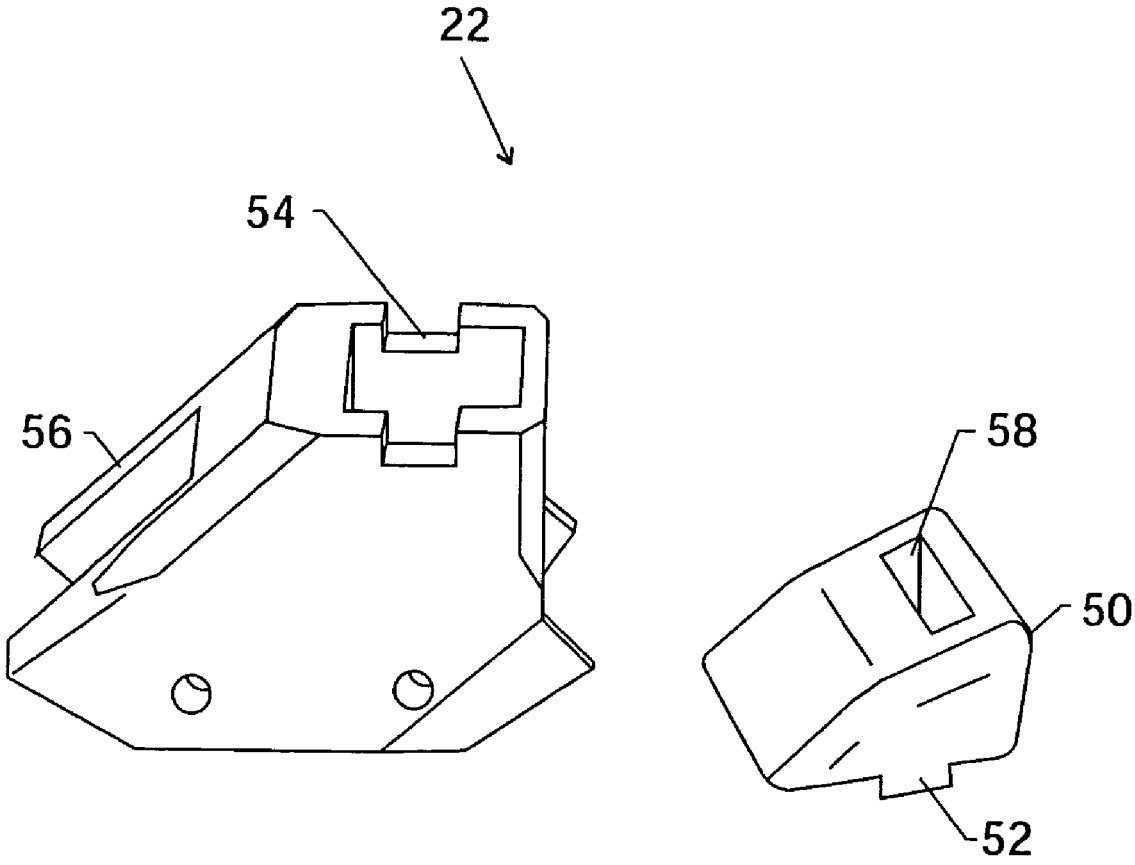
FIG. 5 is a perspective view of an H/D puller comprising a removable tip, in accordance with one aspect of the present technique.

One alternative, however, is to incorporate a removable tip 50 on the H/D puller 22, as depicted in FIG. 5. For example, the removable tip 50 may be include a mating portion 52, such as an interlocking protrusion, which may slide into or out of a conforming portion 54 of the main body 56 of the H/D puller 22. Use of a removable tip 50 allows only that portion of the H/D puller 22 that is abraded, i.e., the tip with the aperture 58, to be replaced.

For example, if system inefficiency is occurring and believed to be due to the abrasive effects of the plasma on the aperture 58, i.e., due to the widening of the aperture, a replacement operation may be undertaken. In particular, the vacuum tank 14 may be opened and the removable tip 50 of one or both of the H/D pullers 22 may be removed by sliding the mating portion 52 of the tip 50 out of the conforming portion 54. A new tip 50 may then be slid into place by engaging the mating portion 52 of the tip with the conforming portion 54 of the main body 56 and sliding the tip 50 into place. Because the main body 56 is not moved or removed, the x and y alignment of the complete H/D puller is not altered and realignment should not be necessary. The vacuum tank 14 may then be sealed and vacated.

While a sliding removable tip 50 with a mating portion 52 has been described, one of ordinary skill in the art will readily apprehend that other removable configurations may be employed. For example, multiple mating portions 52 may be present or the location of the mating portion 52 and conforming portion 54 may be reversed such that the removable tip 50 includes a conforming portion 54 which mates with a mating portion 52, such as an interlocking protrusion, of the main body 56. Indeed, any configuration of a removable tip 50 of an H/D puller 22 is believed to be within the scope of the present technique.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An ion source alignment tool, comprising:

an alignment tool body; and one or more magnetic surfaces configured to retain a first feeler gage and a second feeler gage to the alignment tool body.

2. The ion source alignment tool as recited in claim 1, wherein the one or more magnetic surface are configured to retain the first feeler gage and the second feeler gage orthogonal to one another.

3. A method for aligning an H/D puller and an ion source, comprising:

positioning an alignment tool in a cyclotron such that the alignment tool may be used to align an H/D puller to an ion source;

attaching a first feeler gage and a second feeler gage to at least one magnetic surface of the alignment tool such that the first feeler gage and the second feeler gage measure different dimensions of a plane;

contacting a first surface of the H/D puller adjacent to the first feeler gage and a second surface of the H/D puller adjacent to the second feeler gage to align the H/D puller to the ion source.

4. The method as recited in claim 3, further comprising adjusting one or more adjustment screws on the H/D puller while the H/D puller is in contact with the first and second feeler gages.

5. The method as recited in claim 3, wherein positioning the alignment tool comprises placing the alignment tool in the cyclotron in place of the ion source.

6. The method as recited in claim 3, further comprising adjusting at least one of the first feeler gage and the second feeler gage to correspond to a known alignment dimension.

7. The method as recited in claim 3, wherein the first feeler gage measures an x-dimension and the second feeler gage measures a y-dimension.

8. An H/D puller, comprising:

a removable tip; and a body configured to receive the removable tip.

9. The H/D puller as recited in claim 8, wherein the removable tip comprises one or more mating regions and the body comprises one or more conforming regions configured to receive respective mating regions.

10. The H/D puller as recited in claim 9, wherein the one or more mating regions and the one or more conforming regions are configured to engage by sliding.

11. The H/D puller as recited in claim 8, wherein the removable tip comprises an aperture through which one or more ions may pass into the removable tip and the body.

12. A removable H/D puller tip, comprising one or more mating regions configured to fit one or more respective conforming regions of an H/D puller body.

13. The removable H/D puller tip as recited in claim 12, wherein the H/D puller tip comprises an aperture through which one or more ions may pass.

14. A cyclotron, comprising:

an ion source configured to generate a plurality of ions;

one or more H/D pullers configured to receive one or more ions from the ion source, wherein each H/D puller comprises:

a removable tip; and a body configured to receive the removable tip;

a pair of Dees separated by a gap, wherein at least one of the Dees receives the one or more ions from the one or more H/D pullers;

an extractor configured to redirect the one or more ions after the one or more ions travel a spiral path through the dees and the gap to reach the extractor;

a target chamber configured to receive the one or more redirected ions from the extractor and to collide the one or more redirected ions and a target material to generate a plurality radioactive isotopes;

an electromagnet comprising two poles, wherein the ion source, the one or more H/D pullers, the pair of Dees, and the gap are positioned between the two poles;

a vacuum tank containing the electromagnet, the ion source, the one or more H/D pullers, the pair of dees, the gap, and the extractor; and a computer control unit configured to operate at least one of the ion source, the electromagnet, and the extractor.

15. The cyclotron as recited in claim 14, wherein the extractor comprises one or more extraction foils.

16. The cyclotron as recited in claim 14, wherein the extractor comprises one or more carousels.

17. The cyclotron as recited in claim 14, further comprising a biochemical synthesizer unit configured to generate a radiopharmaceutical using the radioactive isotopes.

18. The cyclotron as recited in claim 14, wherein the removable tip comprises an aperture configured to align with an opposing aperture on the ion source.

19. A method for repairing an H/D puller, comprising:

removing a first H/D puller tip from an H/D puller body; and attaching a second H/D puller tip to the H/D puller body.

20. The method as recited in claim 19, wherein removing the first H/D puller tip comprises sliding a mating region of the first H/D puller tip out of a conforming region of the H/D puller body and wherein attaching the second H/D puller tip comprises sliding the mating region of the second H/D puller tip into the conforming region.

21. A cyclotron, comprising:

an ion source configured to generate a plurality of ions;

one or more H/D pullers configured to receive one or more ions from the ion source, wherein each H/D puller comprises a tip, a body, and means for replacing the tip;

a pair of Dees separated by a gap, wherein at least one of the Dees receives the one or more ions from the one or more H/D pullers;

an extractor configured to redirect the one or more ions after the one or more ions travel a spiral path through the Dees and the gap to reach the extractor;

a target chamber configured to receive the one or more redirected ions from the extractor and to collide the one or more redirected ions and a target material to generate a plurality radioactive isotopes;

an electromagnet comprising two poles, wherein the ion source, the one or more H/D pullers, the pair of dees, and the gap are positioned between the two poles;

a vacuum tank containing the electromagnet, the ion source, the one or more H/D pullers, the pair of Dees, the gap, and the extractor; and a computer control unit configured to operate at least one of the ion source, the electromagnet, and the extractor.

* * * * *